United States Patent [19]

Ogawa et al.

[11] Patent Number: 4,712,742

[45] Date of Patent: Dec. 15, 1987

[54] PREPARATION OF DEASHED HIGH SOLID CONCENTRATION COAL-WATER SLURRY

[75] Inventors: Takayuki Ogawa, Yokohama; Hideaki Ito, Chigasaki; Naokazu Kimura, Tokyo; Hayami Ito, Himeji; Shuhei Tatsumi; Shoichi Takao, both of Akashi; Nitaro Suzuki; Takashi Watanabe, both of Funabashi; Kunizo Shinano, Matsudo; Takashi Kuwabara, Kawasaki; Kaoru Aoki, Hiratsuka, all of Japan

[73] Assignees: Electric Power Development Co., Ltd., Tokyo; Kawasaki Jukogyo Kabushiki Kaisha, Kobe-shi; Sumitomo Heavy Industries, Ltd., Tokyo, all of Japan

[21] Appl. No.: 798,524

[22] Filed: Nov. 15, 1985

[30] Foreign Application Priority Data

Nov. 20, 1984 [JP] Japan ..... 59-246485

[51] Int. Cl.[4] ..... B02C 19/12

[52] U.S. Cl. ..... 241/20; 241/21; 241/24; 241/29; 44/51

[58] Field of Search ..... 241/20, 21, 24, 29; 44/51

[56] References Cited

U.S. PATENT DOCUMENTS

| | | | |
|---|---|---|---|
| 3,596,839 | 8/1971 | Putman | 241/21 X |
| 4,132,365 | 1/1979 | Verschuur | 241/21 |
| 4,265,407 | 5/1981 | Kessler et al. | 241/21 |
| 4,593,859 | 6/1986 | Nakaoji et al. | 241/20 |
| 4,598,873 | 7/1986 | Cleemann | 241/24 X |

FOREIGN PATENT DOCUMENTS

| | | | |
|---|---|---|---|
| 2154471 | 9/1985 | United Kingdom | 241/24 |
| 0995883 | 2/1983 | U.S.S.R. | 241/20 |

*Primary Examiner*—Howard N. Goldberg
*Assistant Examiner*—Taylor J. Ross
*Attorney, Agent, or Firm*—Flynn, Thiel, Boutell & Tanis

[57] ABSTRACT

The present invention relates to a process for preparing a coal-water slurry comprising the steps of screening coal into a coarse-grained coal and a fine-grained coal; subjecting said coarse-grained coal to gravity classification to classify into a low ash coal, a middle ash coal and a high ash coal; wet grinding a mixture of the fine-grained coal, the middle ash coal and part of the low ash coal, and subjecting same to flotation; preparing a first slurry having a solid concentration of 40–60 wt. % from the low ash froth resultant from flotation; and mixing another part of the low ash coal with this first slurry and wet grinding this mixture. This process can accord the solid concentration of the product slurry with an optional target value by adjusting the amount of the low ash coal mixed with the first slurry, and can use the remaining low ash coal not to be added to the first slurry for the purpose of preparing the second product slurry.

6 Claims, 2 Drawing Figures

PREPARATION OF DEASHED HIGH SOLID CONCENTRATION COAL-WATER SLURRY

BACKGROUND OF THE INVENTION

The present invention relates to a process for preparing a deashed high solid concentration coal-water slurry that is easy to handle, as liquid fuel, like heavy oil in pumping, shipment, storing and the like and can be burnt by means of a boiler burner.

It is well known to prepare a coal-water slurry by grinding coal, together with water, but it is called into question how the ash content in this coal should be treated. The coal, which is normally under the ground, contains more or less of noncombustible (ash) comprising $Al_2O_3$, $SiO_2$, $Fe_2O_3$ and the like. The ash contained in the coal-water slurry brings about abrasion of the boiler walls when said slurry is burnt, and lowers the efficiency of combustion of said slurry.

Under these circumstances, in the preparation of a high solid concentration coal-water slurry using a parent coal having a high ash content, there has hitherto been employed a process which comprises subjecting a relatively coarse grain-sized parent coal to gravity classification to thereby obtain a low ash coal, and grinding said low ash coal alone as the slurry material. However, this process has included the problem to be solved that no other coal than the low ash coal can be used as the slurry material, whereby the efficiency of utilization of the coal is low.

In the preparation of a high solid concentration coal-water slurry using a parent coal having a relatively high ash content, furthermore, there has hitherto been proposed a process which comprises grinding said coal and then subjecting its whole the amount of the coal to a deashing treatment, thereby lowering the ash content. However, employment of this process has also included the problems that the deashing equipment is large-sized, and accordingly not only the costs for treatment but also loss of the coal in the deashing treatment are increased.

U.S. Pat. No. 4,132,365 makes obvious a process for preparing a coal-water slurry in which particulate coal is classified and is separated into a plurality of fractions on the basis of the specific gravity thereof. Each fraction is dried and then ground, and then the fraction are mixed. In order to minimize sedimentation of the particles when they are dispersed in the aqueous medium and stabilize the slurry, it is necessary for this patent to grind the fraction having a high specific gravity more finely than the fraction having a lower specific gravity, whereby to retard the sedimentation of the fraction having the large specific gravity when dispered in water.

Some of the present inventors and others have developed a process for preparing a deashed high solid concentration slurry which exhibits a high coal recovery and a high profitability, and have already filed a patent application as U.S. patent application Ser. No. 611,069 now U.S. Pat. No. 4,593,859.

As seen from the block diagram of FIG. 2, this is a process for preparing a deashed high solid concentration slurry containing 60 wt. % or more of coal solids which comprises classifying a previously crushed parent coal into a fine-grained coal and a coarse-grained coal by means of a screen 41; feeding said coarse-grained coal to a gravity separator 42 for classifying it into a low ash coal fraction, a middle ash coal fraction and a high ash coal fraction (refuse); wet-grinding this middle ash coal fraction together with said fine-grained coal by means of a grinding mill 43 to obtain a relatively low solid concentration coal-water slurry; thereafter introducing this slurry into a flotation machine 44 for deash treatment to thereby obtain a deashed slurry (froth); introducing this froth into a dewaterer 45 to thereby obtain a relatively high solid concentration deashed cake mixing this deashed cake with said low ash coal fraction; and wet grinding this mixture by means of a grinding mill 46.

Viewed from the point of grinding the coal, this process illustrated in FIG. 2 adopts a two-stage grinding method which comprises wet-grinding a middle ash coal fraction to obtain a relatively low solid concentration first slurry; adding a coarsely ground low ash coal to this; and wet-grinding this mixture again to thereby obtain a high solid concentration second slurry. Our inventors have found that this wet type two-stage grinding method can obtain preferably particle size distribution of the second slurry by setting the solid concentration of the first slurry in the range of 40–60 wt. % and thus making it easy to control the grain size distribution of the coal in the second slurry. Accordingly, it becomes possible to prepare a deashed high solid concentration coal-water slurry containing about 70 wt. % of coal solids by incorporating both gravity classification and flotation in the wet type two-stage grinding method.

The solid concentration of a coal-water slurry is normally determined by the way in which the sturry will be used. However, the process disclosed in U.S. Pat. No. 4,593,859 is disadvantageous in that all the low ash coal obtained in the gravity classification step is mixed with the first slurry and presented to the final second wet grinding step, and so when the solid concentration of the first slurry is maintained in the range of 40–60 wt. % suitable for wet type two-stage grinding, the solid concentration of the second slurry, namely the finally obtained coal-water slurry varies according to the amount of low ash coal mixed in the first slurry. In other words, the process disclosed in U.S. Pat. No. 4,593,859 is unable to adjust the solid concentration of the coal-water slurry, namely the final product, optionally to a set value determined depending on the way in which the slurry will be used.

SUMMARY TO THE INVENTION

The object of the present invention is to provide a process for preparing a coal-water slurry which is capable of improving the process of U.S. Pat. No. 4,593,859 and optionally adjusting the solid concentration of said coal-water slurry to various solid concentrations required by the ways in which the slurry will be used.

In order to achieve the above mentioned object, the present invention provides a process for preparing a deashed high solid concentration coal-water slurry which comprises the steps of (a) subjecting coal to screening to classify said coal into a coarse-grained coal and a fine-grained coal; (b) subjecting said coarse-grained coal to gravity classification to classify it into a low ash coal, a middle ash coal a high ash coal, said middle ash coal having a specific gravity higher than that of said low ash coal and lower than that of said high ash coal; (c) mixing said fine-grained coal with said coarse middle ash coal and further mixing a first fraction of the coarse low ash coal therein, and wet grinding this mixture to prepare a slurry suitable for flotation; (d) subjecting this slurry to flotation to obtain a froth having a reduced ash content; (e) dewatering this froth and thereafter adding water thereto to thereby prepare a first slurry containing 40–60 wt. % of coal solids; (f) mixing a second fraction of the coarse low ash coal obtained in the step (b) with the first slurry according to the solid concentration of the first slurry so that the solid concentration of a final product coal-water slurry may reach a target concentration; and (g) wet grinding the mixture from the step (f).

Further, the present invention provides a method for maintaining the solid concentration of the final product coal-water slurry at a target concentration by adjusting the grain size of coarse-grained coal in the gravity classification and/or changing the specific gravity of separation in classification between the middle ash coal and the low ash coal.

Still further, the present invention provides a method for maintaining a constant viscosity of the final product slurry by detecting the viscosity of the final product coal-water slurry and finely adjusting the amounts of water and dispersant to be added to the first slurry according to said detected value.

DETAILED DESCRIPTION OF THE INVENTION

Figure 1:
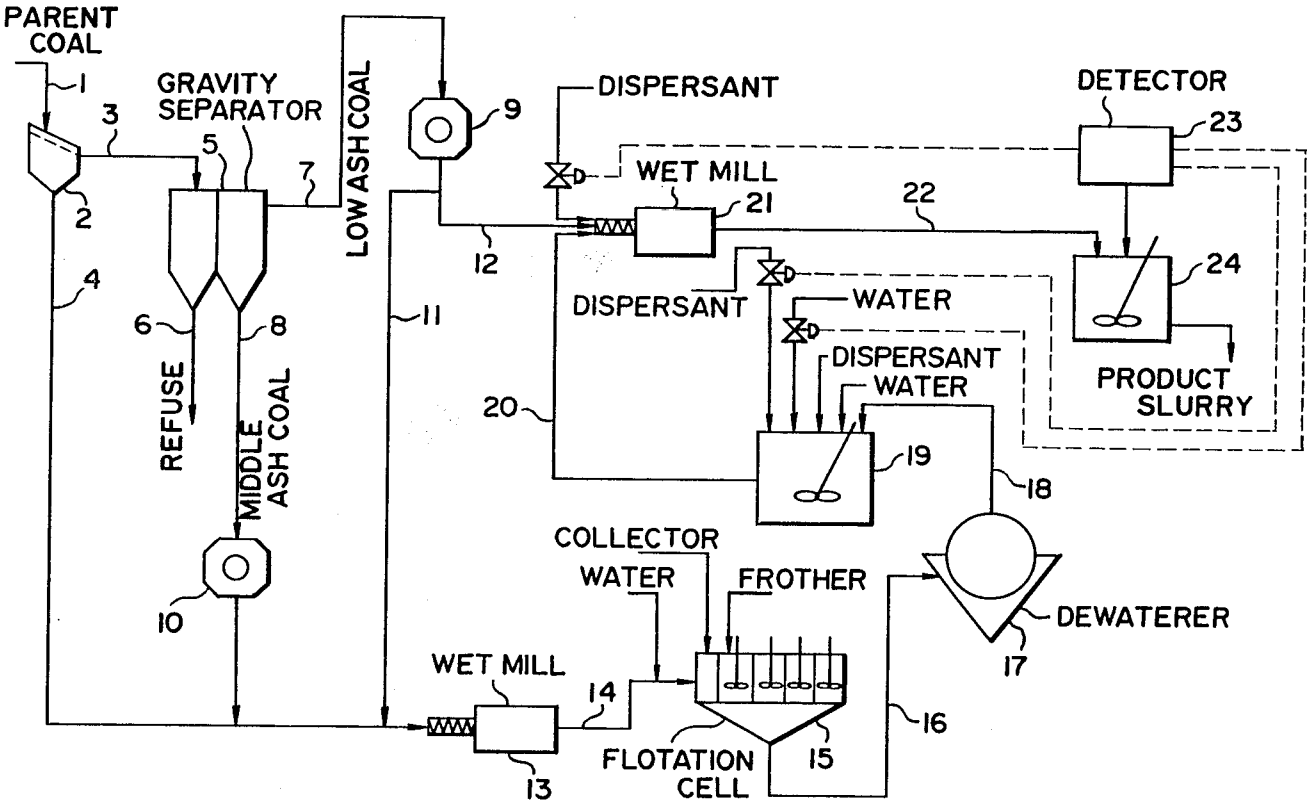
FIG. 1 is a flow diagram illustrating one embodiment of the process according to the present invention.
Figure 2:
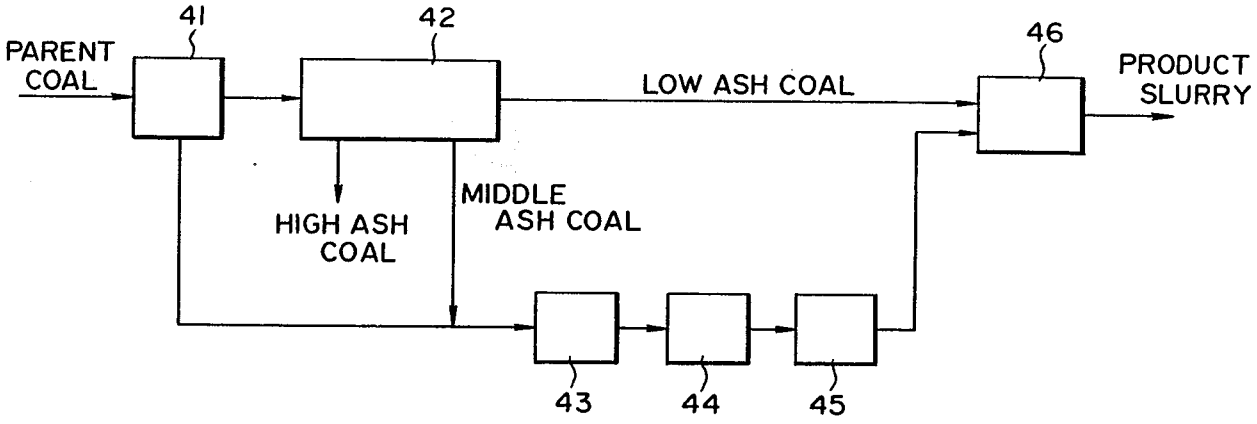
FIG. 2 PRIOR ART
FIG. 2 is a flow diagram illustrating the process disclosed in U.S. Pat. No. 4,593,859.

As stated previously, in the case of preparing a coal-water slurry by means of wet type two-stage grinding, maintenance of the solid concentration of the first slurry in the range 40–60 wt. % makes it easy to adjust the preferable grain size distribution of the coal contained in the finally obtained slurry (the second slurry) and makes it possible to increase its solid concentration. When maintaining the solid concentration of the first slurry in the range of 40–60 wt. %, however, there is the necessity of controlling the amount of coal mixed with the first slurry in order to cause the solid concentration of the second slurry to reach a target value due to the fact that the solid concentration of the second slurry depends on the amount of coal mixed in the first slurry.

In this connection, it is to be noted that in case the solid concentration of the first slurry is $\alpha$%, the weight of coal contained therein is Y, the amount of coal mixed in the first slurry is X and the solid concentration of the product slurry (the second slurry) is $\beta$%, the relationship between $\alpha$, $\beta$ and mixing ratio X/Y can be calculated as shown in Table 1, wherein X and Y are on the dry basis.

TABLE 1

| | $\beta$ (%) | | | | |
|---|---|---|---|---|---|
| $\alpha$ (%) | 60 | 65 | 70 | 75 | 80 |
| 40 | 1.25 | 1.79 | 2.5 | 3.49 | 5.02 |
| 45 | 0.83 | 1.27 | 1.86 | 2.66 | 3.87 |
| 50 | 0.5 | 0.86 | 1.33 | 2.0 | 3.0 |
| 55 | — | 0.52 | 0.92 | 1.45 | 2.78 |
| 60 | — | — | 0.56 | 1.0 | 1.67 |

The value $\beta$ has a peculiar upper limit depending on the physical chemical properties, the grain size distribution of coal contained in the product slurry, the kind of the dispersant used and the like. For instance, the upper limit of solid concentration, using steam coal employed as the fuel coal for electric power plants is normally in the range of 65–75% . Accordingly, it is common that the solid concentration of the product slurry should be established to be lower than the above upper limit according to its use.

In case the value $\beta$ of the product slurry is fixed, there can be established the range of X/Y value. For instance, in case $\beta$ is 70 wt. %, the value of X/Y ratio must be in the range of 0.56–2.5. However, in the mixing of the entire low ash coal obtained through gravity classification in the first slurry, as described in the process according to U.S. Pat. No. 4,593,859, it is difficult to maintain the value of X/Y the ratio in the desired range, and consequently it is difficult to maintain the solid concentration of the final slurry at the target value.

In view of this, the present invention is designed to adjust the amount of the low ash coal to be mixed in the first slurry according to the particular concentration of the first slurry at which the solid concentration is maintained in the range of 40–60 wt. %, thereby to maintain the solid concentration of the product slurry (the second slurry) at the target value. Since the amount of low ash coal to be mixed in the first slurry is limited as mentioned above, the low ash coal obtained by gravity classification is normally excess in amount. According to the process of the present invention, this excess low ash coal is wet ground together with the middle ash coal and the fine-grained coal obtained by screening, then subjected to flotation, and used for the preparation of the first slurry.

The amount of the low ash coal obtained by gravity classification can be adjusted by controlling the grain size of the coarse-grained coal to be subjected to gravity classification and the conditions for gravity classification, in particular changes in the specific gravity used for classification between the middle ash coal and the low ash coal. Accordingly, in case the amount of the low ash coal is controlled by controlling the conditions for screening and conditions for gravity classification, it is possible to maintain the solid concentration of the product slurry at the target value even though the entirety of the low ash coal is mixed in the first slurry.

In any case, the process of the present invention can prepare a coal-water slurry which is in conformity with the solid concentration established by the intended made up use of the product slurry. In case it is desired to adjust the viscosity of said slurry, however, it can be achieved by detecting its viscosity by means of a detector and controlling the amounts of water and dispersant added to the first slurry or the amount of dispersant added to the second slurry in response to this detected signal.

The present invention will be explained with reference to the drawings, hereinafter. FIG. 1 is a flow sheet illustrating an embodiment of the present invention, wherein normally, a parent coal crushed so as to have a particle diameter of 300 mm or less, preferably 150 mm or less, is fed to a screen 2 and screened. As said screen, there is normally employed the one of 0.1–20 mm aperture size, preferably 0.5–2 mm. Oversize particles are fed from a line 3 into a gravity separator 5 wherein a high ash coal in said parent coal is removed through a line 6 as refuse, and the remaining coal is classified into a low ash coal and a middle ash coal. The principle of separation in this gravity separator is to utilize the difference in specific gravity caused by the difference in the ash content of the coal. In case the undersize particles contain a large amount of slime, it is preferable to separate the slime by means of a suitable treatment.

The above mentioned low ash coal and middle ash coal are introduced into coarse grinders 9 and 10 through lines 7 and 8 respectively, and coarse ground so as to have a particle diameter of 30 mm or less, preferably 5 mm or less. The admixture of coarse ground middle ash coal and fine-grained coal or this mixture added with coarse ground low ash coal from a line 11 is fed in a wet grinder 13 together with water, and is ground to obtain a slurry having a solid concentration of 5–60 wt. %, preferably 10–50 wt. %. This grinding is carried out preferably so that 50% or more of the coal solids have a particle size of less than 200 mesh, and more preferably so that 70% or more of coal solids have a particle size of less than 200 mesh. A dispersant can be added to the wet grinder 13. The amount of said dispersant added is in the range of 0.01–3 wt. %, preferably 0.1–1 wt. %, base on the weight of the coal. The slurry obtained by means of the wet grinder may be added with water when necessary, and is introduced into a flotation machine 15 through a line, while having a solid concentration of 5–15 wt. %.

Flotation is carried out by adding a collector in an amount 0.05–0.3 wt. %, preferably 0.1–0.25 wt. %, base on the weight of the coal and a frother in an amount of 0.02–0.15 wt. %, preferably 0.03–0.1 wt. %, based on the weight of the coal, whereby a froth having a dashed coal concentration of 15–30 wt. %, preferably 18–25 wt. % is recovered in a line 16. The froth from the flotation machine is introduced into a dewaterer 17 for dewatering, fed to a concentration adjusting tank 19 through a line 18, and adding same with water and a dispersant in tank 19 to thereby prepare a first slurry having a solid concentration of 40–60 wt. %. This first slurry is fed to a wet grinder 21 through a line 20. The first slurry is mixed with a coarse ground low ash coal fed in a line 12 from a coarse grinder 9. The amount of the low ash coal fed to the line 12 is determined by the solid concentration of first slurry and that of final product slurry fed in line 22. The residual low ash coal is fed in a wet grinder 13 through the line 11.

When necessary, a dispersant is added to said wet grinder 21 for grinding the low ash coal, whereby a deashed coal-water slurry having a desired concentration exceeding the solid concentration of 60 wt. % is prepared. Then, this slurry is introduced into a storage tank 24, and fine adjusting the amount of water or dispersant fed in the concentration adjusting tank 19 and the amount of a dispersant fed in a wet grinder 21 if necessary, in response to a signal emitted from a detector 23 installed in the storage tank, whereby the properties of the final product slurry can be maintained constantly.

The amount of the dispersant added is 0.01–4 wt. %, preferably 0.1–2 wt. %, based on the weight of the coal. Wet grinding using the wet grinder 21 is carried out so that from 50% to 90% of coal solids may have a particle size of less than 200 mesh, and preferably so that 1% or less of coal solids may have a particle size of 48 mesh or less and 60% or more of coal solids may have a particle size of 200 mesh or less.

In the present invention, the dispersants are used for the purpose of stabilizing the fluidity of the slurry, and include anionic, cathionic and nonionic surface active agents, and they may be used singly or in combination which is selected properly according to the kind of coal used. Citing concrete examples of each surface active agent, the anionic agents include salts of sulfuric acid esters of fatty oils, salts of sulfuric acid esters of higher alcohols, salts of sulfuric acid esters of ethers, salts of sulfuric esters of olefines, alkyl allyl sulfonic acid salts, sulfonic acid esters of dibasic acid ester, salts of dialkyl sulfo succinic acid, acylsarcosinate, salts of alkyl benzene sulfonic acid, acylsarcosinate, salts of alkyl benzene sulfonic acid, salts of alkyl sulfonic acid esters, salts of dialkylsulfo succinic acid esters, alkyl acid or/and maleic anhydride copolymer, polycyclic aromatic sulfonate, fornalin compound and the like. As cationic surface active agents, there can be enumerated alkyl amine salts, quaternary amine salts and the like. The nonionic surface active agents used herein include polyoxy alkyl ethers, polyoxy ethylene alkyl phenol ethers, oxyethylene-oxypropylene block polymers, polyoxyethylene alkyl amines, sorbitan fatty acid esters, polyoxy ethylene sorbitan fatty acid esters and the like.

As collectors, there are used kerosene, light oil, residual oils, fatty acid, extra pure amine and the like. As the frother, there are used pine oil, cresols, $C_5$–$C_8$ alcohols, and surface active agents.

PREFERRED EMBODIMENTS

Next, there will be given examples of preparing deashed high concentration slurries containing 70 wt. % of coal solids respectively.

Example 1 shows the case of introducing part of a low ash coal to a flotation step together with a middle ash coal and a fine-grained coal, Example 2 shows the case where the particle size of a coarse-grained coal subjected to gravity classification has been changed, and Example 3 shows the case where the specific gravity of separation in gravity classification has been changed, respectively.

EXAMPLE 1

By using parent coal having a particle size of 20 mm or less and an ash content of 8.2%, there was prepared a deashed high concentration slurry according to the process shown in FIG. 1, wherein the separation specific gravity between a low ash coal and a middle ash coal was 1.4 and that between said middle ash coal and refuse was 1.6. The obtained results are shown in Table 2.

1570 g of the parent coal was screened by means of a 0.5 mm-mesh screen to obtain 94 g (6.0 wt. %) of undersize particles having an ash content of 15.0% and 1476 g (94.0 wt. %) of oversize particles having an ash content of 7.8%.

These coarse-grained oversize particles were subjected to gravity classification. 75 g (4.8 wt. %) of the coarse-grained oversize particles having an ash content of 55% were separated as refuse, and the remainder was classified into 1243 g (79.2 wt. %) low ash coal having an ash content of 4.6% and 157 g (10.0 wt. %) middle ash coal having a relatively high ash content (9.0%). The thus obtained low ash coal and middle ash coal were subjected to coarse grinding so that 90% of said coarse ground coal had a particle size of 3 mm or less. The water content of each coarse ground coal was 15%. Part (236 g) of the coarse ground low ash coal was mixed with the coarse ground middle ash coal and said 0.5 mm - mesh undersize fine-grained coal to thereby obtain 487 g (31.0 wt. %) of mixture having an ash content of 8.0%. Water was added to this mixture to adjust the slurry concentration to become 50%, and thereafter was ground in a wet mill so that 75% of the coal might have a particle size of 200 mesh (74 μm) or less. Water was added again to this ground matter to adjust the solid concentration to be 10 wt. %, thereafter a collector (residual oil) in an amount of 0.2 wt. % per coal and a frother (Methyl Isobutyl carbinol (MIBC)) in an amount of 0.1 wt. % per coal were added to same for flotation in order to remove 42 g (2.7 wt. %) of tail having an ash content of 41%, and thus 444 g (28.3 wt. %) of a flotation froth having an ash content of 4.9% was recovered. This flotation froth was subjected to deash treatment.

This flotation froth had a solid concentration of 20 wt. %. This froth was dewatered by means of Buchner funnel to obtain a dewatered cake having a solid concentration of 68 wt. %. Water was added to this dewatered cake and simultaneously a dispersant was added thereto in an amount of 0.8 wt. % per coal to thereby obtain a deashed coal-water slurry whose solid concentration of 50 wt. %. This slurry was subjected to wet grinding together with said surplus coarse ground low ash coal having a water content of 15 wt. %, whereby a high concentration slurry having desired particle size distribution and a concentration of 70 wt. % could be obtained. This high concentration slurry was observed to have an ash content of 4.7% and to have yield of 92.5%.

The line numbers given in Table 2 correspond to those given in FIG. 1.

EXAMPLE 2

A deashed high concentration slurry was prepared by using the same parent coal (particle size: 10 mm or less) as used in Example 1 according to the process shown in FIG. 1, wherein the specific gravity of separation between a low ash coal and a middle ash coal was 1.4, and that between said middle ash coal and refuse was 1.6. The obtained results are shown in Table 3.

800 g of the parent coal was screened by means of a 0.5 mm-mesh screen to obtain 101 g (12.6 wt. %) of undersize particles having an ash content of 10.0% and 699 g (87.4 wt. %) of oversize particles having an ash content of 7.9%.

These coarse-grained oversize particles were subjected to gravity classification. 52 g (6.5 wt. %) of the coarse-grained oversize particles having an ash content of 52.2% were separated as refuse, and thereafter the remainder was classified into 487 g (60.9 wt. %) low ash coal having an ash content of 3.1% and 160 g (20.0 wt. %) middle ash coal having a relatively high ash content (8.8%). The thus obtained low ash coal and middle ash coal were subjected to coarse grinding so that 90% of said coarse ground coal had a particle size of 3 mm or less. The water content of each coarse ground coal was 15%.

This middle ash coal and said 0.5 mm-mesh undersize fine-grained coal were mixed to obtain 261 g (32.6 wt. %) of a mixture having an ash content of 9.3%. Water was added to this mixture to adjust the slurry concentration to become 45%, and thereafter was ground in a wet mill so that 75% of the coal might have particle size of 200 mesh (74 μm) or less. Water was added again to this ground matter to adjust the solid concentration to be 10 wt. %, thereafter a collector (residual oil) in an amount of 0.1 wt. % per coal and a frother (MIBC) in an amount of 0.04 wt. % per coal were added thereto for flotation in order to remove 17 g (2.1 wt. %) of tail having an ash content of 37.4 wt. %, and thus 244 g (30.5 wt. %) of a flotation forth having an ash content of 7.3% was recovered. This flotation froth was subjected to deash treatment.

The solid concentration of this flotation froth was 20 wt. %. This froth was subjected to Buchner funnel to obtain a dewatered cake having a solid concentration of 68 wt. %. Water was added to this dewatered cake, and simultaneously a dispersant was added thereto in an amount of 0.8 wt. % per coal to thereby obtain a deashed coal-water slurry whose solid concentration of 51.8 wt. %. This slurry was subjected to wet grinding together with said surplus coarse ground low ash coal having a water content of 15 wt. %, whereby a high concentration slurry having a desired particle size distribution and a concentration of 70 wt. % could be obtained. This high concentration slurry was observed to have an ash content of 4.5% and to have yield of 91.4%.

EXAMPLE 3

Preparation of a deashed high solid concentration slurry was investigated according to the substantially same process shown in FIG. 1 except that a parent coal having a particle size of 15 mm or less and an ash content of 11.3% was employed and that, the specific gravity in separation of a low ash and middle ash coal was 1.3 and 1.4. The results are shown in Table 4. 2000 g of said parent coal was screened by means of a 0.5 mm-mesh screen. Oversize particles were divided into a low ash coal and a middle ash coal based on a specific gravity of separation of 1.3 and 1.4 respectively. The specific gravity of separation of a middle ash coal is the same as that of a refuse, namely 1.6. Each fraction obtained by the above classification was measured in respect of weight and ash content. It can be seen from the obtained results that the amount of the low ash coal changes markedly as the specific gravity of separation changes.

The middle ash coal was coarse ground, thereafter mixed with a fine-grained coal, and added with water. Same was ground in a wet grinder so that 75–90% of said ground particles might have a particle size of 200 mesh (74 μm) or less. Thus, there was obtained a slurry having a ground coal concentration of 10%. The flotation characteristics of this slurry was calculated experimentally by changing the amounts of a collector and a frother added thereto. Flotation conditions were calculated so that the amount of combustibles contained in the total of a refined coal and a low ash coal recovered by this flotation might occupy 95% of the parent coal, and the typical values of this flotation test, namely refined coal, ash content and yield, were calculated from test data on the basis of said flotation conditions.

The above operation was carried out with reference to classified coarse-grained coals different in specific gravity of separation from each other. The obtained results were summarized in Table 4. On the basis of above obtained values, the ratio of the amount of low ash coal X' to the coal amount of the first slurry Y' was calculated. It was found that the value of this X'/Y' ratio was 3.48 and 0.53, and can satisfy the desired range of X/Y shown in Table 1 by changing the specific gravity of separation in the coarse grain classification.

TABLE 2

| Line No. | 1 | 3 | 4 | 6 | 7 | 8 | 11 | 12 | 14 | 16 | 18 | 20 | 22 |
|---|---|---|---|---|---|---|---|---|---|---|---|---|---|
| Coal (dry), wt. %* | 100 | 94.0 | 6.0 | 4.8 | 79.2 | 10.0 | 15.0 | 64.2 | 31.0 | 28.3 | 28.3 | 28.3 | 92.5 |
| Ash, wt. % | 8.2 | 7.8 | 15.0 | 55.0 | 4.6 | 9.0 | 4.6 | 4.6 | 8.0 | 4.9 | 4.9 | 4.9 | 4.7 |
| Water, wt. % | | 15 | 20 | 15 | 15 | 15 | 15 | 15 | 90 | 80 | 32 | 50 | 30 |

*dry basis

TABLE 3

| Line No. | 1 | 3 | 4 | 6 | 7 | 8 | 11 | 12 | 14 | 16 | 18 | 20 | 22 |
|---|---|---|---|---|---|---|---|---|---|---|---|---|---|
| Coal (dry), wt. %* | 100 | 87.4 | 12.6 | 6.5 | 60.9 | 20.0 | 0 | 60.9 | 32.6 | 30.5 | 30.5 | 30.5 | 91.4 |
| Ash, wt. % | 8.2 | 7.9 | 10.0 | 52.2 | 3.1 | 8.8 | 0 | 3.1 | 9.3 | 7.3 | 7.3 | 7.3 | 4.5 |
| Water, wt. % | | 15 | 20 | 15 | 15 | 15 | 0 | 15 | 90 | 80 | 32 | 48.2 | 30 |

*dry basis

TABLE 4

| | | sp. gr. = 1.4 | sp. gr. = 1.3 |
|---|---|---|---|
| Gravity classification | | | |
| Low ash coal (%) | Yield | 69.9 | 31.0 |
| | Ash content | 3.7 | 1.9 |
| Middle ash coal plus Fine-grained coal (%) | Yield | 23.2 | 62.1 |
| | Ash content | 17.1 | 9.6 |
| Refuse (%) | Yield | 6.9 | 6.9 |
| | Ash content | 69.1 | 69.1 |
| Flotation | | | |
| Ash content of coal fed to flotation (%) | | 17.1 | 9.6 |
| Ash content of clean coal (%) | | 16.0 | 9.0 |
| Yield (%) | | 86.6 | 95.4 |
| Ash content of product slurry (%) | | 6.4 | 6.6 |
| Recovery factor of combustibles (%) | | 95.0 | 95.0 |
| X'/Y' | | 3.48 | 0.53 |

COMPARATIVE EXAMPLE

By using the same parent coal as Example 1 and under the same coarse-grained coal classification conditions as Example 1, the operation of gravity separation was carried out. Differing from the slurry producing conditions in example 1, in this example the entire low ash coal is used in the second slurry. The resulting middle ash coal was coarse ground, and thereafter mixed with a fine-grained coal to thereby obtain 251 g (16 wt. %) of a mixture having an ash content of 11.3%. Water was added to this mixture to adjust so as to have a slurry concentration of 50%, and thereafter same was ground in a wet mill so that 75% of said coal might have a particle size of 200 mesh (74 μm) or less. Water was added again to this ground matter to adjust the solid concentration to be 15 wt. %, and thereafter a collector (residual oil) in an amount of 0.1 wt. % per coal and a frother (MIBC) in an amount of 0.03 wt. % per coal were added thereto for flotation in order to remove 31 g (2.0 wt. %) of tail having an ash content of 50 wt. %, whereby 220 g (14.0 wt. %) of a flotation froth having an ash content of 5.8% was obtained. The ratio X'/Y' of the low ash coal to the flotation clean coal was 5.66, and was observed not to satisfy the desired range shown in Table 1 and deviate from the superior grinding conditions required for the final stage.

According to the process of the present invention, there can be obtained a deashed, desirably high solid concentration coal-water slurry in a high recovery factor through the steps of classifying a parent coal into a low ash coal having negligibly low ash content and a middle ash coal having a relatively high ash content under pertinently selected gravity classification conditions; subjecting part of said low ash coal together with said middle ash coal to flotation for deash treatment; further dewatering same to prepare a slurry having a solid concentration of 40–60 wt. %; and mixing the remainder of the low ash coal to this slurry.

We claimed:

1. A process for preparing a deashed high solid concentration coal-water slurry comprising the steps of:
   (a) subjecting a parent coal to screening to classify it into a coarse-grained coal and a fine-grained coal;
   (b) subjecting said coarse-grained coal to gravity classification to classify it into a low ash coal, a middle ash coal and a high ash coal, said middle ash coal having a specific gravity higher than that of said low ash coal and lower than that of said high ash coal;
   (c) mixing said fine-grained coal with said coarse middle ash coal and further mixing a first fraction of the coarse low ash coal therein, and wet grinding this mixture to prepare a slurry suitable for flotation, said first fraction being about 15% by weight, based on the weight of said parent coal;
   (d) subjecting said slurry to flotation to thereby obtain a froth having a reduced ash content;
   (e) dewatering said froth and thereafter adding water thereto to thereby prepare another slurry containing 40–60 wt. % of coal solids;
   (f) mixing the balance of the coarse low ash coal obtained in the step (b) with said another slurry according to the solid concentration of said another slurry so that the solid concentration of the final product coal-water slurry may take a target value; and
   (g) wet grinding the mixture from the step (f) to obtain the final product coal-water slurry.

2. A process according to claim 1 wherein said parent coal has a particle size of 20 mm or less and it is classified into a coarse-grained coal and a fine-grained coal by means of a 0.5 mm - aperture screen.

3. A process according to claim 1 wherein, in step (C), said low ash coal and said middle ash coal are each set ground so as to have a particle size of 3 mm or less.

4. A process according to claim 1 wherein, in step (C), said coal solids are wet ground so that 70% or more thereof may have a particle size of 200 mesh or less.

5. A process according to claim 1 wherein, in step (9), the coal solids are wet ground so that 60% or more thereof may have a particle size of 200 mesh or less and 1% or less thereof may have a particle size of 48 mesh or less.

6. A process for preparing a deashed, coal-water slurry having a solid concentration ($\beta$%) of from 60 to 80%, comprising the steps of:

(a) subjecting parent coal particles containing ash to screening to classify them into coarse-grained coal particles and fine-grained coal particles;

(b) subjecting said coarse-grained coal particles to gravity classification to classify said coarse-grained coal particles into (i) coarse-grained low-ash coal particles, (ii) coarse-grained middle-ash coal particles and (iii) coarse-grained high-ash coal particles, said coarse-grained middle-ash coal particles having a higher specific gravity than said coarse-grained low-ash coal particles and having a lower specific gravity than said coarse-grained high-ash coal particles;

(c) mixing said fine-grained coal particles, said coarse-grained middle-ash coal particles and a first fraction of said coarse-grained low-ash particles to form a mixture, and wet grinding the mixture to obtain an aqueous slurry suitable for flotation;

(d) subjecting the aqueous slurry to flotation to obtain a froth of coal particles having a reduced ash content;

(e) dewatering said froth and thereafter adding water thereto to prepare a first, reduced-ash slurry having a solid concentration ($\alpha$%) of from 40 to 60% and containing an amount Y of coal;

(f) mixing the remainder of said coarse-grained low-ash coal particles containing an amount X of coal, with said first, reduced-ash slurry so that the solid concentration ($\beta$%) of the mixture thereby formed is from 60 to 80%; and (g) wet grinding the mixture from step (f) to obtain said deashed, coal-water slurry; the amount of said first fraction of said coarse-grained low-ash particles being such that the ratio of X/Y has values in the range of from 0.5 to 5.02, as set forth in the columns in the following Table, depending on the values of $\alpha$% and $\beta$%

| | Values for X/Y | | | | |
|---|---|---|---|---|---|
| | $\beta$ (%) | | | | |
| $\alpha$ (%) | 60 | 65 | 70 | 75 | 80 |
| 40 | 1.25 | 1.79 | 2.5 | 3.49 | 5.02 |
| 45 | 0.83 | 1.27 | 1.86 | 2.66 | 3.87 |
| 50 | 0.5 | 0.86 | 1.33 | 2.0 | 3.0 |
| 55 | — | 0.52 | 0.92 | 1.45 | 2.78 |
| 60 | — | — | 0.56 | 1.0 | 1.67 |

the amount of said first fraction of said coarse-grained low-ash particles being such that said remainder of said coarse-grained low-ash coal particles will increase the solid concentration of said first, reduced-ash slurry to the desired solid concentration of said deashed, coal-water slurry.

* * * * *

UNITED STATES PATENT AND TRADEMARK OFFICE

CERTIFICATE OF CORRECTION

PATENT NO. : 4 712 742

DATED : December 15, 1987

INVENTOR(S) : Takayuki OGAWA et al

It is certified that error appears in the above-identified patent and that said Letters Patent is hereby corrected as shown below:

Column 10, line 59; change "(C)" to ---(c)---.
line 60; change "set" to ---wet---.
line 62; change "(C)" to ---(c)---.
line 64; change "(9)" to ---(g)---.

Signed and Sealed this

Twenty-sixth Day of July, 1988

*Attest:*

DONALD J. QUIGG

*Attesting Officer*

*Commissioner of Patents and Trademarks*